US009711322B2

(12) United States Patent
Shimono

(10) Patent No.: US 9,711,322 B2
(45) Date of Patent: Jul. 18, 2017

(54) X-RAY TUBE DEVICE

(71) Applicant: Toshiba Electron Tubes & Devices Co., Ltd, Otawara-shi (JP)

(72) Inventor: Takashi Shimono, Nasushiobara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 31 days.

(21) Appl. No.: 14/953,212

(22) Filed: Nov. 27, 2015

(65) Prior Publication Data

US 2016/0163499 A1 Jun. 9, 2016

(30) Foreign Application Priority Data

Dec. 3, 2014 (JP) ..... 2014-244917

(51) Int. Cl.
*H01J 35/18* (2006.01)

(52) U.S. Cl.
CPC ..... *H01J 35/18* (2013.01)

(58) Field of Classification Search
CPC .. H01J 35/16; H01J 35/18; H01J 35/14; H01J 5/18; H01J 2235/16
See application file for complete search history.

(56) References Cited

U.S. PATENT DOCUMENTS 5,802,140 A 9/1998 Virshup et al.
7,290,929 B2 * 11/2007 Smith ..... H05G 1/02 378/121
2014/0023176 A1 * 1/2014 Ohashi ..... A61B 6/06 378/62
2014/0369467 A1 * 12/2014 Yamazaki ..... H01J 35/16 378/51

FOREIGN PATENT DOCUMENTS

| | | |
|---|---|---|
| CN | 101790901 A | 7/2010 |
| CN | 201780961 U | 3/2011 |
| JP | 6-251735 | 9/1994 |
| JP | 2007-141510 | 6/2007 |
| JP | 2014-143089 | 8/2014 |
| WO | WO 2012/077463 A1 | 6/2012 |

OTHER PUBLICATIONS

Office Action issued Feb. 23, 2017 in Chinese Patent Application No. 201510881218.7 (with English translation).

* cited by examiner

*Primary Examiner* — Hoon Song

(74) *Attorney, Agent, or Firm* — Oblon, McClelland, Maier & Neustadt, L.L.P.

(57) ABSTRACT

An X-ray tube device in one embodiment has an X-ray tube and a container storing the X-ray tube, filled with insulating oil, and having an X-ray emission window. The X-ray tube includes a cylindrical glass envelope holding an anode and a cathode opposite to each other and keeping them in vacuum, and an insulating tube fit over the glass envelope and having an X-ray transmission section. The insulating tube has a base section attached to the container. The base section defines a space communicating between the X-ray transmission section of the insulating tube and the X-ray emission window of the container, and has a container-side end fixed to the container in a liquid-tight manner.

9 Claims, 3 Drawing Sheets

X-RAY TUBE DEVICE

CROSS-REFERENCE TO RELATED APPLICATIONS

This application is based upon and claims the benefit of priority from Japanese Patent Application No. 2014-244917, filed Dec. 3, 2014, the entire contents of which are incorporated herein by reference.

FIELD

Embodiments described herein relate generally to an X-ray tube device.

BACKGROUND

Medical apparatuses and industrial apparatuses, which diagnose a photographic subject using X-rays, use an X-ray tube device as an X-ray source. It is known that a food production line, for example, employs a continuous non-destructive inspection which uses X-rays to inspect any defect in each product.

A device which comprises a container having an X-ray emission window from which X-rays are emitted is well-known as an X-ray tube device used for this kind of inspection. A cathode and an anode, with which electron beams emitted from the cathode collide and from which X-rays are produced, are housed in a cylindrical glass envelope which is kept in a vacuum condition. The glass envelope is fitted into an insulating tube. The insulating tube is immersed in insulating oil which fills the container.

DETAILED DESCRIPTION

Embodiments will be described hereinafter with reference to the accompanying drawings.

An X-ray tube device in one embodiment generally comprises:

an X-ray tube including:

a cathode to emit an electron beam;

an anode to collide with the electron beam emitted from the cathode and to produce X-rays;

a cylindrical glass envelope holding the anode and the cathode opposite to each other and keeping them in vacuum; and an insulating tube fit over the glass envelope and having an X-ray transmission section; and a container, storing the X-ray tube, filled with insulating oil, and having an X-ray emission window, the insulating tube having a base section attached to the container, the base section defining a space communicating between the X-ray transmission section of the insulating tube and the X-ray emission window of the container, and having a container-side end fixed to the container in a liquid-tight manner.

Now, an X-ray tube device 1 in one embodiment of the present invention will be explained in detail.

Figure 1:
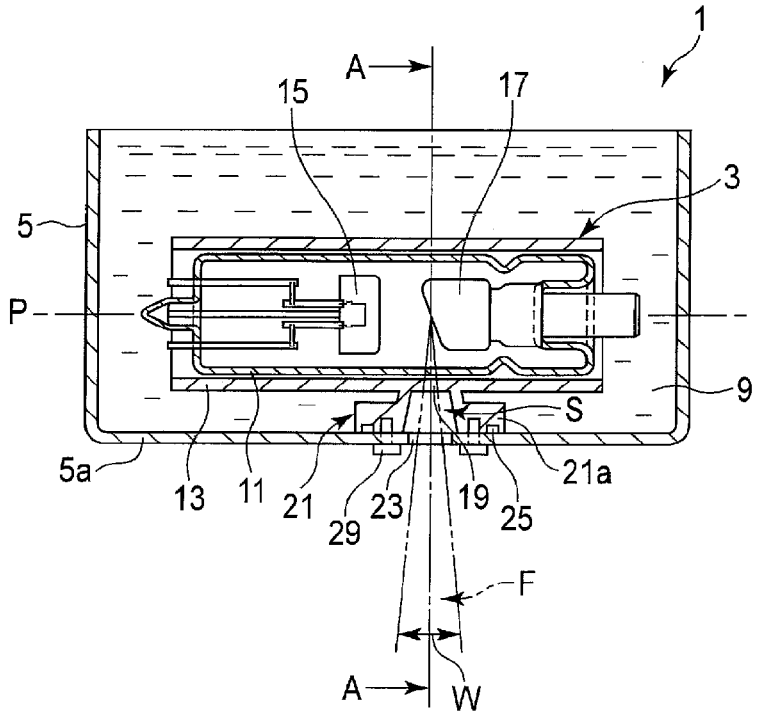
FIG. 1 is a sectional view illustrating the general structure of an X-ray tube device in one embodiment.
Figure 2:
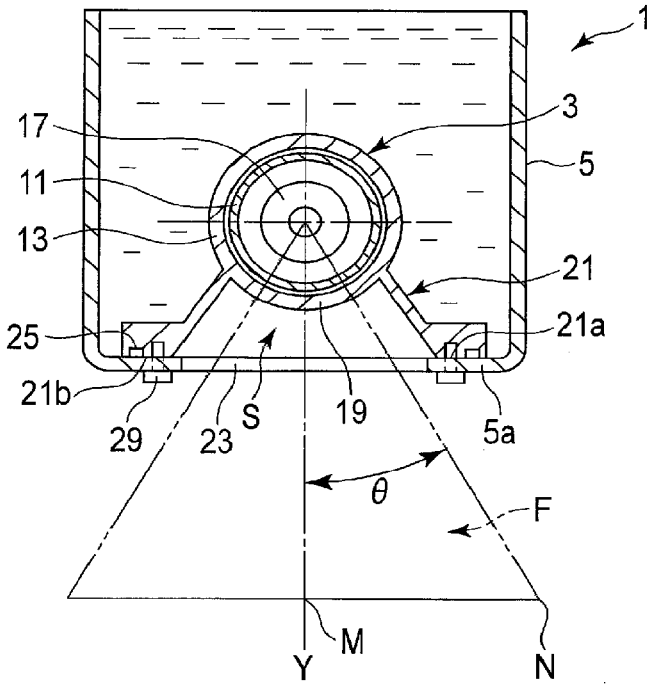
FIG. 2 is an A-A sectional view illustrated in FIG. 1.

As illustrated in FIG. 1 and FIG. 2, the X-ray tube device 1 comprises an X-ray tube 3 and a container 5 which accommodates the X-ray tube 3.

The X-ray tube 3 has a cylindrical glass envelope 11 maintaining a vacuum, and a cylindrical insulating tube 13 fit over the cylindrical glass envelope 11. The glass envelope 11 includes a cathode 15, which emits an electron beam, and an anode 17, with which the electron beam emitted from the cathode 15 collides, and from which X-rays are produced by the collision.

The insulating tube 13 promotes electrical insulation. In the present embodiment, the epoxy resin which is good in electrical insulation and high in mechanical strength is used for the insulating tube 13.

The insulating tube 13 has an X-ray transmission section 19 which allows penetration of the X-rays having been emitted from the anode 17 and having passed through the glass envelope 11.

Figure 3:
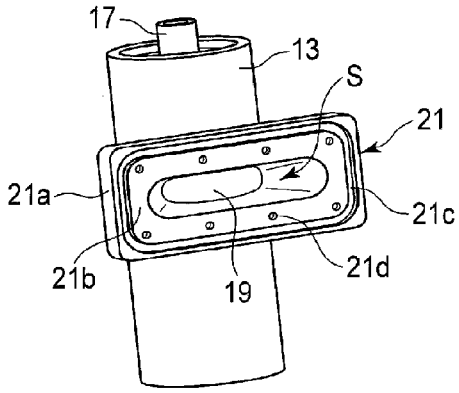
FIG. 3 is a perspective view of the X-ray tube which has a base section as illustrated in FIG. 1 and is seen from the bottom side of the base section.

As illustrated in FIG. 1 through FIG. 3, the insulating tube 13 has a base section 21 which surrounds the X-rays transmission section 19 of the insulating tube 13 and allows the insulating tube 13 to be fixed in the container 5. The insulating tube 13 and the base section 21 form a single unit. The base section 21 will be described later in detail.

The container 5 is filled with insulating oil 9. The X-ray tube 3 is immersed in the insulating oil 9 in the container 5. Although not illustrated in the figures, the X-ray tube 3 is connected to a drive source which supplies electric power. The insulating oil 9 achieves electrical insulation between the X-ray tube 3 and the drive source, and cooling of the X-ray tube 3.

The container 5 has at its bottom 5*a* an X-ray emission window 23. The X-ray emission window 23 is an aperture located at a position which faces the X-ray transmission section 19 of the insulating tube 13.

The base section 21 defines a space S which communicates between the X-ray transmission section 19 of the insulating tube 13 and the X-ray emission window 23 of the container 5. The base section 21 includes a container-side end 21*a* having a contact surface 21*b* abutting on the bottom 5*a* of the container 5.

The container-side end 21*a* of the base section 21 surrounds the X-ray emission window 23. As illustrated in FIG. 3, the contact surface 21*b*, which is brought into contact with the bottom 5*a* of the container 5, has an O-ring groove 21*c*, which extends along the whole perimeter of the contact surface 21*b* and receives an O-ring 25 (see FIG. 1 and FIG. 2).

The contact surface 21*b* has screw holes 21*d* which are at a peripheral region of the contact surface 21*b* surrounded by the O-ring groove 21*c* and are aligned at intervals along the O-ring groove 21*c*. The container-side end 21*a* is tightly fixed to the bottom 5*a* by screws 29 (See FIG. 1 and FIG. 2) externally inserted into the respective screw holes 21*d* and tightly screwed into the bottom 5*a* of the container 5.

The space S in the base section 21 has the shape of a fan which corresponds to a fan-shaped zone of emitted X-rays F.

The space S is approximately trapezoidal in its cross section vertically sectioned along the axis P of the insulating cylinder 13, as illustrated in FIG. 1. The space S further has, as illustrated in FIG. 2, the shape of an approximate sector, which is larger than an aperture angle θ defined with respect to the central line Y, in its cross section which perpendicularly intersects with the axis P of the insulating cylinder 13 (see FIG. 1).

Now, the function and advantage of the X-ray tube device 1 in the present embodiment will be explained.

In the X-ray tube device 1 in the present embodiment, electron beams emitted from the cathode 15 will collide with the anode 17 to produce X-rays. The X-rays produced at the anode 17 will be transmitted through the glass envelope 11 and the X-ray transmission section 19 of the insulating tube 13, and will be emitted from the X-ray emission window 23 of the container 5 in the shape of a fan having a width W and an aperture angle θ with respect to the central line Y.

Since the X-rays emitted from the anode 17 in the present embodiment will pass through the X-ray transmission section 19 of the cylindrical insulating tube 13, travel through the space S of the base section 21, and finally pass through the X-ray emission window 23, X-rays will only pass through a limited portion of the insulating oil 9 which fills a narrow gap between the glass envelope 11 and the X-ray transmission section 19 of the cylindrical insulating tube 13. It is therefore possible to prevent as much as possible the insulating oil 9 from acting as a shield against X-rays and from obstructing X-rays.

The X-ray emission window 23 formed in the container 5 is an aperture. The X-ray transmission member provided conventionally is not exist in the present embodiment. Accordingly, it will never happen that any X-ray transmission member functions as a filter against X-rays. Attenuation of X-rays will be surely prevented in the present embodiment.

It should be noted that the distance covered by an X-ray having traveled through the fan-shaped zone of emitted X-rays F and having passed through the center position M is shorter than the distance covered by an X-ray having traveled through the fan-shaped zone of emitted X-rays F and having passed through the position N of the aperture angle θ. Therefore, when the X-ray emission window 23 is provided with the X-ray transmission member, or when the insulating oil 9 fills a space between the X-ray transmission section 19 and the X-ray emission window 23, the latter X-ray will decrease in intensity much more than the former X-ray because the latter X-ray must remain in the X-ray transmission member of the X-ray emission window 23 or each of the insulating oil 9 and the X-ray emission window 23 longer than the former X-ray does owing to their respective routes. The conventional devices have such a problem. In contrast, in the present embodiment, the X-ray emission window 23 is an aperture, and there is no insulating oil 9 between the X-ray transmission section 19 and the X-ray emission window 23. Accordingly, the decrease in intensity of an X-ray on passing through the position N of the aperture angle θ will be entirely avoided.

Consequently, even when the X-ray tube device 1 in the present embodiment is used as a device for examination of a product by the application of X-rays having a predetermined spread, a decrease in inspection accuracy in the fan-shaped zone of emitted X-rays F will be prevented. Furthermore, it is possible to use those X-rays that form the shape of a fan whose aperture angle θ is larger than before.

Moreover, the space S formed in the base section 21 has a large area at the side of the X-ray emission window 23. Accordingly, the base section 21 will not obstruct the fan-shaped zone of emitted X-rays F, which covers a predetermined spread.

Furthermore, the base section 21 has inclined sides so that the space S may become wider in cross-sectional area towards the X-ray emission window 23 and thus a large area may be secured for the base section 21 to be fixed to the bottom 5*a* of the container 5. This means that the space S which conforms to the fan-shaped zone of emitted X-rays F will be obtained, and that the base section 21 will secure a sufficiently large area to be fixed to the container 5. Consequently, the X-ray tube 3 will be stably supported.

Figure 4:
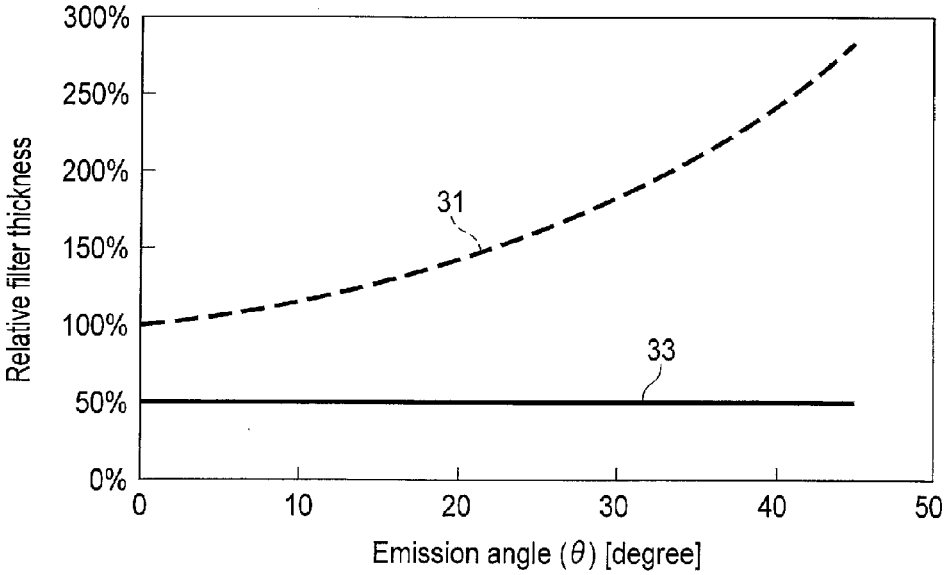
FIG. 4 is a graph which illustrates the difference between the present embodiment and a comparative example in terms of relation between the emission angle of an X-ray beam and relative filter thickness.

Here, the relation between the emission angle (θ) of the X-rays emitted from the X-ray tube device 1 in the present embodiment and the relative filter thickness through which the emitted X-rays are transmitted will be explained in comparison with a comparative example with reference to FIG. 4.

Figure 5:
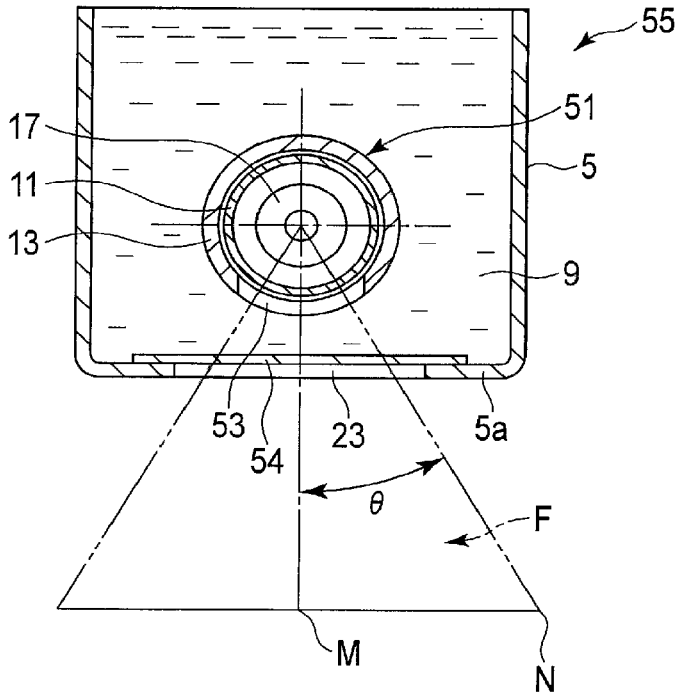
FIG. 5 is a sectional view illustrating the general structure of an X-ray tube device in a comparative example.
Figure 6:
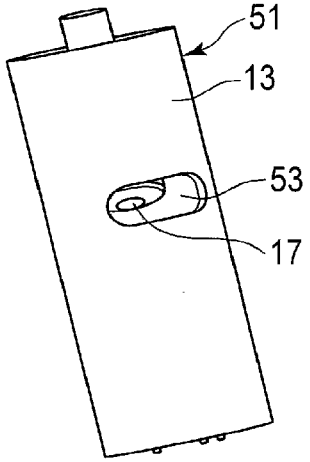
FIG. 6 is a perspective view of the X-ray tube which is illustrated in FIG. 5 and is seen from the side of an X-ray emission aperture.

First of all, an X-ray tube device 55 in a comparative example will be explained with reference to FIG. 5 and FIG. 6. As illustrated in FIG. 6, an X-ray tube 51 in the comparative example has an insulating cylinder 13 which has an X-ray emission aperture 53. Moreover, as illustrated in FIG. 5, the X-ray tube device 55 does not have a base section 21 between the X-ray tube 51 and an X-ray emission window 23 formed in the bottom 5*a* of a container 5, but there is a body of insulating oil 9 between the X-ray tube 51 and the bottom 5*a* of the container 5. Moreover, a closure member 54 closes the X-ray emission window 23, or an aperture, formed in the bottom 5*a* of the container 5.

In the comparative example, as illustrated in FIG. 5, the X-rays produced at an anode 17 travels through the glass envelope 11, the insulating oil 9, and the closure member 54. These transmission sections are considered to constitute a relative filter thickness, and the relative filter thickness is assumed to be 100% (see FIG. 4). In this case, an X-ray having passed through the glass envelope 11 and having reached the position N of the aperture angle θ and an X-ray having passed through the glass envelope 11 and having reached the center position M may be the same in filter thickness which must be passed through. However, any X-ray which passes through a position distant from the center position M should obliquely pass trough the insulating oil 9 and the closure member 54 compared with the X-ray which passes through the center position M. Accordingly, as illustrated in FIG. 4 by the broken line 31, when the relative filter thickness of the center position M is assumed to be 100%, the relative filter thickness becomes large as the emission angle θ becomes large.

In contrast, in the present embodiment, since the inside of the base section 21 is the space S and the X-ray emission window 23 is an aperture, X-rays only pass through the cylindrical glass envelope 11, a limited portion of the insulating oil 9 which fills a narrow gap between the glass envelope 11 and the X-ray transmission section 19, and the cylindrical insulating tube 13, but do not pass through the closing member 54 and a vast body of the insulating oil 9 filling a space between the closing member 54 and the cylindrical insulating tube 13. Accordingly, as illustrated in FIG. 4 by the solid line 33, the relative filter thickness through which an X-ray passing through the center position M must pass will be about half of that of the comparative example. Relative filter thickness therefore will be about 50%. Moreover, an X-ray passing through a position which is distant from the center position M by the emission angle θ will be the same as an X-ray passing through the center position M in relative filter thickness which must be passed through. Relative filter thickness therefore will still be about 50%.

Accordingly, the present embodiment will surely prevent attenuation of X-rays compared with the comparative example, and will make it possible to obtain X-rays of uniform intensity in arbitrary positions of aperture angle θ.

Since the base section 21 is fixed to the bottom 5*a* of the container 5 through the O-ring 25, the base section 21 can hold the space S airtight with simple structure.

Moreover, since the container-side end 21*a* of the base section 21 is fixed to the container with the screws 29 applied from the outer side of the container, the maintenance of the device such as looking for the screws 29 that may have worked loose from use, for instance, will be easy.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the shape of the space S formed in the base section 21 is not specifically restricted, but can be variously changed.

Moreover, the aperture angle θ and width W of the fan-shaped zone of emitted X-rays F can be variously changed at one's discretion.

The following modification may be possible. Namely, an upper surface may be provided to the container 5. The X-ray emission window 23 may be formed in the upper surface. The X-ray tube 3 may be fixed to the upper surface by the base section 21. X-rays may be emitted upward from the upper surface. Alternatively, the X-ray emission window 23 may be formed in the sidewall of the container. The X-ray tube 3 may be fixed to the sidewall by the base section 21. X-rays may be emitted horizontally from the sidewall.

It is preferable that the base section 21 should be fixed to the container 5 in such a manner that the space S will be liquid tightly secured. The means for fixing the base section 21 to the container 5 is not restricted to a mechanical means such as screws etc., but welding etc. may be used for their fixation so long as the space S can be liquid tightly secured.

Furthermore, a device that has a lead X-ray shielding material provided to the outer peripheral surface of the insulating tube 13 except the fan-shaped zone of emitted X-rays F is known as a modification of the comparative example illustrated in FIG. 5 and FIG. 6. Similarly, it is possible to provide an X-ray shielding material in the outer peripheral surface of the insulating tube 13 or the surface of a base section as a modification of the embodiment of the present invention.

What is claimed is:

1. An X-ray tube device comprising:

an X-ray tube including:

a cathode to emit an electron beam;

an anode to collide with the electron beam emitted from the cathode and to produce X-rays;

a cylindrical glass envelope holding the anode and the cathode opposite to each other and keeping them in vacuum; and an insulating tube fit over the glass envelope and having an X-ray transmission section; and a container, storing the X-ray tube, filled with insulating oil, and having an X-ray emission window, the insulating tube having a base section attached to the container, the base section defining a space and having a container-side end fixed to the container in a liquid-tight manner, the space communicating between the X-ray transmission section of the insulating tube and the X-ray emission window of the container.

2. The X-ray Lube device of claim 1, wherein the space defined by the base section becomes large in area with approaching to the X-ray emission window.

3. The X-ray tube device of claim 2, wherein the base section has inclined sides and becomes wider in cross-sectional area from the X-ray transmission section of the insulating tube towards the X-ray emission window of the container.

4. The X-ray tube device of claim 1, wherein an O-ring is between the container-side end of the base section and the bottom of the container.

5. The X-ray tube device of claim 2, wherein an O-ring is between the container-side end of the base section and the bottom of the container.

6. The X-ray tube device of claim 1, wherein an O-ring is between the container-side end of the base section and the bottom of the container.

7. The X-ray tube device of claim 4, wherein the container-side end of the base section is fixed to the container by externally applied screws.

8. The X-ray tube device of claim 5, wherein the container-side end of the base section is fixed to the container by externally applied screws.

9. The X-ray tube device of claim 6, wherein the container-side end of the base section is fixed to the container by externally applied screws.

* * * * *